US006995519B2

(12) United States Patent
Arnold et al.

(10) Patent No.: US 6,995,519 B2
(45) **Date of Patent: *Feb. 7, 2006**

(54) OLED DISPLAY WITH AGING COMPENSATION

(75) Inventors: Andrew D. Arnold, Hilton, NY (US); Ronald S. Cok, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 84 days.

This patent is subject to a terminal disclaimer.

(21) Appl. No.: 10/721,123

(22) Filed: Nov. 25, 2003

(65) Prior Publication Data

US 2005/0110420 A1 May 26, 2005

(51) Int. Cl.
*G09G 3/10* (2006.01)
*G09G 3/32* (2006.01)

(52) U.S. Cl. ..... 315/169.3; 315/291; 345/82; 345/214

(58) Field of Classification Search ..... 315/169.3, 315/169.1, 291; 345/76, 82, 84, 98, 214, 345/208, 83, 204; G09G 3/10, 3/32
See application file for complete search history.

(56) References Cited

U.S. PATENT DOCUMENTS

| | | | | |
|---|---|---|---|---|
| 4,471,347 | A | 9/1984 | Nakazawa et al. | 340/719 |
| 4,751,659 | A | 6/1988 | Hecht | 364/518 |
| 4,769,292 | A | 9/1988 | Tang et al. | 428/690 |
| 5,061,569 | A | 10/1991 | VanSlyke et al. | 428/457 |
| 5,159,525 | A | 10/1992 | Eaton et al. | 361/283 |
| 5,216,504 | A | 6/1993 | Webb et al. | 358/139 |
| 5,281,960 | A | 1/1994 | Dwyer, III | 345/31 |
| 5,428,370 | A | 6/1995 | Knapp et al. | 345/205 |
| 5,521,639 | A | 5/1996 | Tomura et al. | 348/243 |
| 5,592,215 | A | 1/1997 | Kuga | 348/51 |
| 5,594,463 | A | 1/1997 | Sakamoto | 345/76 |
| 5,739,809 | A | 4/1998 | McLaughlin et al. | 345/150 |
| 5,742,339 | A | 4/1998 | Wakui | 348/233 |
| 5,910,792 | A | 6/1999 | Hansen et al. | 345/74 |
| 6,057,924 | A | 5/2000 | Ross et al. | 356/381 |
| 6,097,462 | A | 8/2000 | Koe | 349/123 |
| 6,229,508 | B1 | 5/2001 | Kane | 345/82 |
| 6,335,713 | B1 | 1/2002 | Imai | 345/76 |
| 6,344,930 | B1 | 2/2002 | Kaneko et al. | 359/666 |
| 6,414,661 | B1 | 7/2002 | Shen et al. | 345/82 |
| 6,456,016 | B1 | 9/2002 | Sundahl et al. | 315/291 |
| 6,504,565 | B1 | 1/2003 | Narita et al. | 347/237 |
| 6,518,962 | B2 | 2/2003 | Kimura et al. | 345/211 |
| 6,870,323 | B1 * | 3/2005 | Cok | 315/169.3 |
| 2002/0047550 | A1 | 4/2002 | Tanada | 315/155 |
| 2002/0167474 | A1 | 11/2002 | Everitt | 345/82 |

(Continued)

FOREIGN PATENT DOCUMENTS

| | | |
|---|---|---|
| EP | 0 378 249 | 7/1990 |

(Continued)

*Primary Examiner*—Trinh Vo Dinh
(74) *Attorney, Agent, or Firm*—Andrew J. Anderson

(57) ABSTRACT

An organic light emitting diode (OLED) display includes an array of OLEDs, each OLED having two terminals; a voltage sensing circuit for each OLED including a transistor in each circuit connected to one of the terminals of a corresponding OLED for sensing the voltage across the OLED to produce feedback signals representing the voltage across the OLEDs; and a controller responsive to the feedback signals for calculating a correction signal for each OLED and applying the correction signal to data used to drive each OLED to compensate for the changes in the output of each OLED.

5 Claims, 4 Drawing Sheets

U.S. PATENT DOCUMENTS

| | | | | |
|---|---|---|---|---|
| 2002/0171611 | A1 * | 11/2002 | Cok | 345/82 |
| 2003/0016201 | A1 | 1/2003 | Ayres et al. | 345/98 |
| 2003/0048243 | A1 | 3/2003 | Kwasnick | 345/82 |
| 2003/0071804 | A1 * | 4/2003 | Yamazaki et al. | 345/204 |
| 2003/0071821 | A1 | 4/2003 | Sundahl et al. | 345/589 |
| 2003/0122813 | A1 | 7/2003 | Ishizuki et al. | 345/211 |
| 2004/0070558 | A1 * | 4/2004 | Cok et al. | 345/76 |
| 2004/0150590 | A1 * | 8/2004 | Cok et al. | 345/76 |
| 2004/0150594 | A1 * | 8/2004 | Koyama et al. | 345/82 |

FOREIGN PATENT DOCUMENTS

| | | |
|---|---|---|
| EP | 1 079 361 | 2/2001 |
| EP | 1 091 339 | 4/2001 |
| EP | 1 282 101 | 2/2003 |
| JP | 04-269790 | 9/1992 |
| JP | 2002-169511 | 6/2002 |
| JP | 2002-278514 | 9/2002 |
| WO | 01/20591 | 3/2001 |

* cited by examiner

OLED DISPLAY WITH AGING COMPENSATION

FIELD OF THE INVENTION

The present invention relates to solid-state OLED flat-panel displays and more particularly to such displays having means to compensate for the aging of the organic light emitting display.

BACKGROUND OF THE INVENTION

Solid-state organic light emitting diode (OLED) displays are of great interest as a superior flat-panel display technology. These displays utilize current passing through thin films of organic material to generate light. The color of light emitted and the efficiency of the energy conversion from current to light are determined by the composition of the organic thin-film material. Different organic materials emit different colors of light. However, as the display is used, the organic materials in the display age and become less efficient at emitting light. This reduces the lifetime of the display. The differing organic materials may age at different rates, causing differential color aging and a display whose white point varies as the display is used. In addition, each individual pixel may age at a different rate than other pixels resulting in display nonuniformity.

The rate at which the materials age is related to the amount of current that passes through the display and, hence, the amount of light that has been emitted from the display. One technique to compensate for this aging effect in polymer light emitting diodes is described in U.S. Pat. No. 6,456,016 issued Sep. 24, 2002 to Sundahl et al. This approach relies on a controlled reduction of current provided at an early stage of use followed by a second stage in which the display output is gradually decreased. This solution requires that the operating time of the display be tracked by a timer within the controller which then provides a compensating amount of current. Moreover, once a display has been in use, the controller must remain associated with that display to avoid errors in display operating time.

This technique has the disadvantage of not representing the performance of small-molecule organic light emitting diode displays well. Moreover, the time the display has been in use must be accumulated, requiring timing, calculation, and storage circuitry in the controller. Also, this technique does not accommodate differences in behavior of the display at varying levels of brightness and temperature and cannot accommodate differential aging rates of the different organic materials.

U.S. Pat. No. 6,414,661 B1 issued Jul. 2, 2002 to Shen et al. describes a method and associated system that compensates for long-term variations in the light-emitting efficiency of individual organic light emitting diodes (OLEDs) in an OLED display, by calculating and predicting the decay in light output efficiency of each pixel based on the accumulated drive current applied to the pixel and derives a correction coefficient that is applied to the next drive current for each pixel. This technique requires the measurement and accumulation of drive current applied to each pixel, requiring a stored memory that must be continuously updated as the display is used, requiring complex and extensive circuitry.

U.S. Patent Application 2002/0167474 A1 by Everitt, published Nov. 14, 2002, describes a pulse width modulation driver for an OLED display. One embodiment of a video display comprises a voltage driver for providing a selected voltage to drive an organic light emitting diode in a video display. The voltage driver may receive voltage information from a correction table that accounts for aging, column resistance, row resistance, and other diode characteristics. In one embodiment of the invention, the correction tables are calculated prior to and/or during normal circuit operation. Since the OLED output light level is assumed to be linear with respect to OLED current, the correction scheme is based on sending a known current through the OLED diode for a duration sufficiently long to allow the transients to settle out and then measuring the corresponding voltage with an analog-to-digital converter (A/D) residing on the column driver. A calibration current source and the A/D can be switched to any column through a switching matrix. This design requires the use of a integrated, calibrated current source and A/D converter, greatly increasing the complexity of the circuit design.

U.S. Pat. No. 6,504,565 B1 issued Jan. 7, 203 to Narita et al., describes a light-emitting display which includes a light-emitting element array formed by arranging a plurality of light-emitting elements, a driving unit for driving the light-emitting element array to emit light from each of the light-emitting elements, a memory unit for storing the number of light emissions for each light-emitting element of the light-emitting element array, and a control unit for controlling the driving unit based on the information stored in the memory unit so that the amount of light emitted from each light-emitting element is held constant. An exposure display employing the light-emitting display, and an image forming apparatus employing the exposure display are also disclosed. This design requires the use of a calculation unit responsive to each signal sent to each pixel to record usage, greatly increasing the complexity of the circuit design.

JP 2002278514 A by Numeo Koji, published Sep. 27, 2002, describes a method in which a prescribed voltage is applied to organic EL elements by a current-measuring circuit and the current flows are measured; and a temperature measurement circuit estimates the temperature of the organic EL elements. A comparison is made with the voltage value applied to the elements, the flow of current values and the estimated temperature, the changes due to aging of similarly constituted elements determined beforehand, the changes due to aging in the current-luminance characteristics and the temperature at the time of the characteristics measurements for estimating the current-luminance characteristics of the elements. Then, the total sum of the amount of currents being supplied to the elements in the interval during which display data are displayed, is changed so as to obtain the luminance that is to be originally displayed, based on the estimated values of the current-luminance characteristics, the values of the current flowing in the elements, and the display data.

This design presumes a predictable relative use of pixels and does not accommodate differences in actual usage of groups of pixels or of individual pixels. Hence, accurate correction for color or spatial groups is likely to be inaccurate over time. Moreover, the integration of temperature and multiple current sensing circuits within the display is required. This integration is complex, reduces manufacturing yields, and takes up space within the display.

U.S. Patent Application 2003/0122813 A1 titled "Panel Display Driving Display And Driving Method" by Ishizuki et al published Jul. 3, 2003 discloses a display panel driving device and driving method for providing high-quality images without irregular luminance even after long-time use. The value of the light-emission drive current flowing when causing each light-emission elements bearing each pixel to independently emit light in succession is measured, then the luminance is corrected for each input pixel data based on the above light-emission drive current values, associated with the pixels corresponding to the input pixel data. According to another aspect, the voltage value of the drive voltage is adjusted in such a manner that one value among each measured light-emission drive current value becomes equal to a predetermined reference current value. According to a further aspect, the current value is measured while an off-set current component corresponding to a leak current of the display panel is added to the current outputted from the drive voltage generator circuit and the resultant current is supplied to each of the pixel portions.

This design presumes an external current detection circuit sensitive enough to detect the relative current changes in a display due to a single pixel's power usage. Such circuits are difficult to design and expensive to build. Moreover, the measurement techniques are iterative and therefore slow and rely upon a voltage source drive while OLED displays are preferably controlled using constant current sources.

There is a need therefore for an improved aging compensation approach for organic light emitting diode display.

SUMMARY OF THE INVENTION

The need is met according to the present invention by providing an organic light emitting diode (OLED) display that includes an array of OLEDs, each OLED having two terminals; a voltage sensing circuit for each OLED including a transistor in each circuit connected to one of the terminals of a corresponding OLED for sensing the voltage across the OLED to produce feedback signals representing the voltage across the OLEDs; and a controller responsive to the feedback signals for calculating a correction signal for each OLED and applying the correction signal to data used to drive each OLED to compensate for the changes in the output of each OLED.

ADVANTAGES

The advantages of this invention are an OLED display that compensates for the aging of the organic materials in the display without requiring extensive or complex circuitry for accumulating a continuous measurement of display light emitting element use or time of operation, accommodates constant current pixel drive circuits, and uses simple voltage measurement circuitry.

DETAILED DESCRIPTION OF THE INVENTION

Figure 1A:
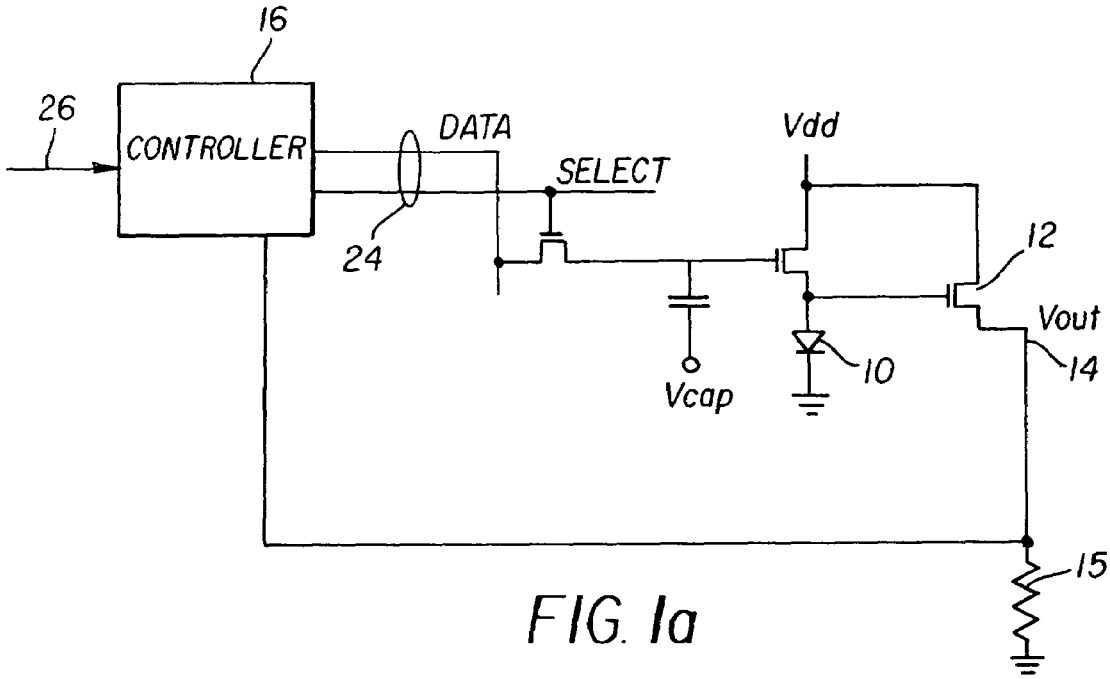
FIG. 1*a* is a schematic diagram of an OLED pixel with feedback and control circuits according to one embodiment of the present invention.
Figure 1B:
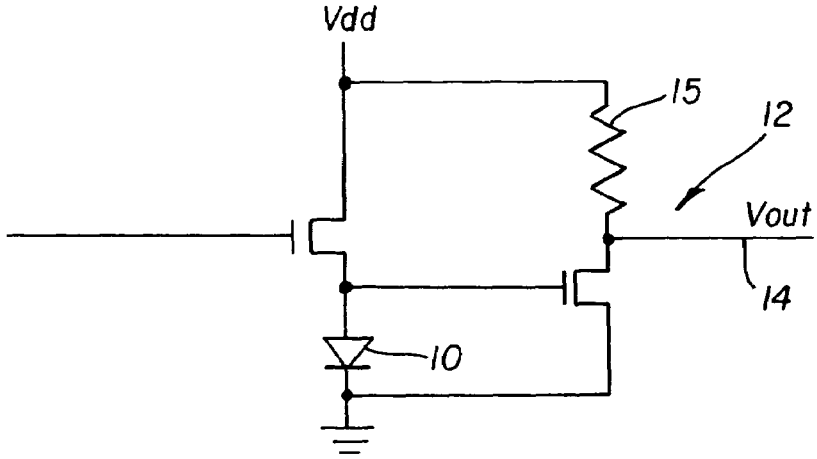
FIG. 1*b* is a schematic diagram of an alternate feedback circuit according to the present invention.

Referring to FIG. 1*a*, an organic light emitting diode (OLED) display according to one embodiment of the present invention comprises an array of OLED light emitting elements 10 (only one of which is shown), each OLED having two terminals; a voltage sensing circuit for each OLED including a transistor 12 in each circuit connected to one of the terminals of a corresponding OLED for sensing the voltage across the OLED to produce a feedback signal 14 representing the voltage across the OLED displays; and a controller 16 for controlling the organic light emitting diode display and responsive to input signal 26 and the feedback signal 14 for calculating a corrected control signal 24 for the OLED and applying the corrected control signal 24 to data used to drive each OLED to compensate for the changes in the output of each OLED 10. A load resistor 15 that is connected between the transistor 12 and ground generates a voltage proportional to the voltage across OLED 10. FIG. 1*b* illustrates an alternate configuration of the voltage sensor. In this embodiment, the load resistor 15 is connected to the power Vdd line rather than the ground. The load resistor may be provided in a variety of locations, including in the controller. In the embodiments show in FIGS. 1*a* and 1*b*, a separate feedback signal 14 may be provided for each OLED or group of OLEDs that are to be measured.

Figure 2:
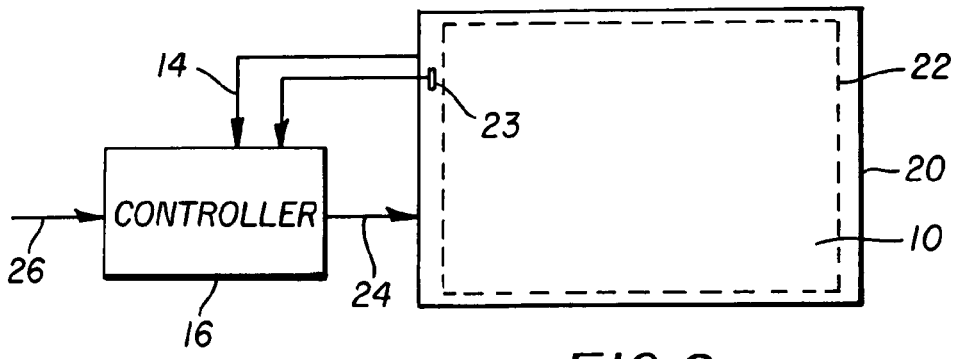
FIG. 2 is a schematic diagram an OLED display according to the present invention.

Referring to FIG. 2, a display is formed on a substrate 20 including an array 22 of OLED light emitting elements 10 responsive to corrected control signals 24 produced by controller 16. The controller 16 is responsive to input signal 26 and feedback signal 14. Control means on the substrate 20 for driving the light emitters 10, for example transistors and capacitors may be provided and are well known in the art, as are suitable controllers 16. The feedback signal 14 is taken from one of the terminals of the OLED light emitter 10; the other terminal is connected to a known voltage available on the substrate 20 or provided by controller 16, for example a ground or other specified voltage.

According to one embodiment of the present invention, the controller 16 includes means to selectively activate all of the light emitters 10 in the array 22 and responds to the feedback signal for calculating a correction signal for the selectively activated light emitting elements 10. The controller 16 applies the correction signal to input signals 26 to produce corrected signals 24 that compensate for the changes in the output of the selectively activated light emitters.

In one embodiment, the present invention may be applied to a color image display comprising an array of pixels, each pixel including a plurality of different colored light emitting elements 10 (e.g. red, green and blue) that are individually controlled by the controller 16 to display a color image. The colored light emitting elements 10 may be formed by different organic light emitting materials that emit light of different colors, alternatively, they may all be formed by the same organic white light emitting materials with color filters over the individual elements to produce the different colors. In another embodiment, the light emitting elements 10 are individual graphic elements within a display and may not be organized in a regular array (not shown). In either embodiment, the light emitting elements may have either passive- or active-matrix control and may either have a bottom-emitting or top-emitting architecture.

Figure 3A:
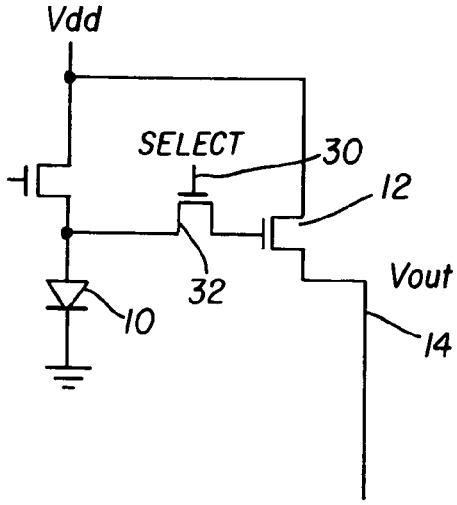
FIGS. 3*a* and 3*b* are schematic diagrams of alternative feedback and control circuits for an OLED display according to the present invention.
Figure 3B:
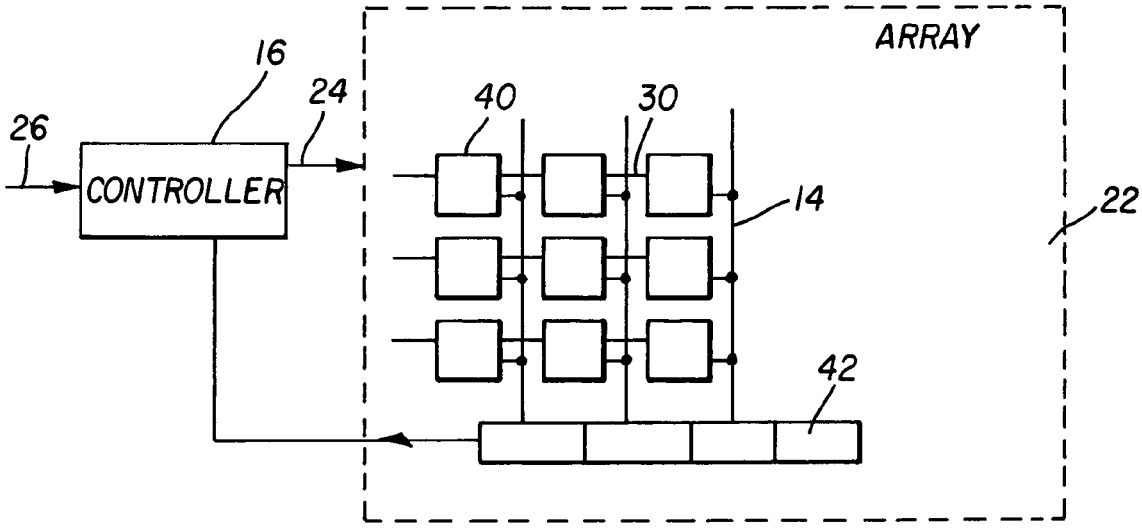

As shown in FIG. 3*a*, an alternative means for controlling the output of the feedback signal 14 to the controller may be used, for example with a select signal 30 and select transistor 32. The select signal may be the same signal used to control the activation of the light emitter 10, or alternatively, may be a separate signal. In this embodiment, a separate line to each OLED is not required. Referring to FIG. 3*b*, an array 22 of pixels 40 having light emitters 10 (not shown) are arranged in groups (for example rows or columns) having feedback signal outputs 14 combined on a single line, thereby making this embodiment practical for displays having larger numbers of OLEDs. In this arrangement, rows of light emitters 10 in pixels 40 may be energized and selected simultaneously. The feedback signal 14 for each column can be deposited into an analog shift register 42 and clocked out of the display and into the controller using means well known in the art. Other circuit arrangements are also possible, for example multiplexers. It is also possible to energize and select light emitters 10 in pixels 40 having a common feedback signal line 14, in which case the feedback signals 14 are combined into a single feedback signal and output directly to the controller 16 or through circuitry such as the shift register 42.

Figure 4:
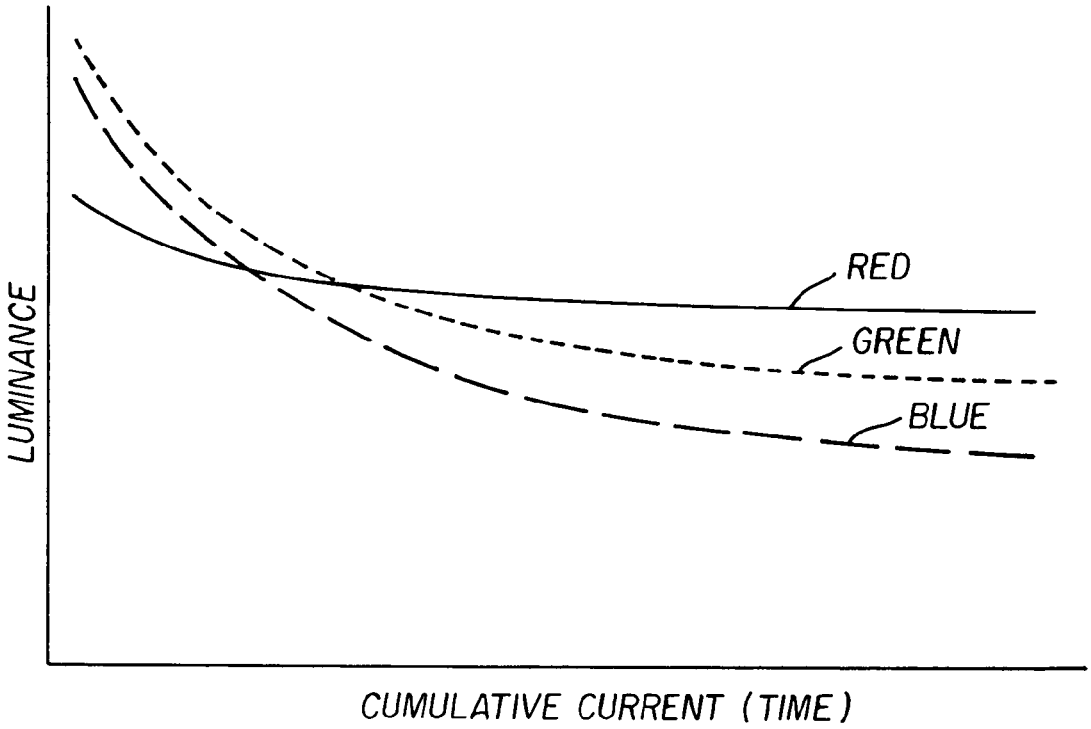
FIG. 4 is a diagram illustrating the aging of OLED displays.

Referring to FIG. 4, a graph illustrating the typical light output of an OLED display as current is passed through the OLEDs is shown. The three curves represent typical performance of the different light emitters emitting differently colored light (e.g. R,G,B representing red, green and blue light emitters, respectively) as represented by luminance output over time or cumulative current. As can be seen by the curves, the decay in luminance between the differently colored light emitters can be different. The differences can be due to different aging characteristics of materials used in the differently colored light emitters, or due to different usages of the differently colored light emitters. Hence, in conventional use, with no aging correction, the display will become less bright and the color, in particular the white point, of the display will shift.

The aging of the OLEDs is related to the cumulative current passed through the OLED resulting in reduced performance, also the aging of the OLED material results in an increase in the apparent resistance of the OLED that causes a decrease in the current passing through the OLED at a given voltage. The decrease in current is directly related to the decrease in luminance of the OLED at a given voltage. In addition to the OLED resistance changing with use, the light emitting efficiency of the organic materials is reduced.

By measuring the luminance decrease and its relationship to the decrease in current through an OLED with a given feedback signal 14, a change in corrected signal 24 necessary to cause the OLED light emitting element 10 to output a nominal luminance for a given input signal 26 may be determined. These changes can be applied by the controller 16 to correct the light output to the nominal luminance value desired. By controlling the signal applied to the OLED light emitter, an OLED light emitter with a constant luminance output and increased lifetime at a given luminance is achieved.

Figure 5:
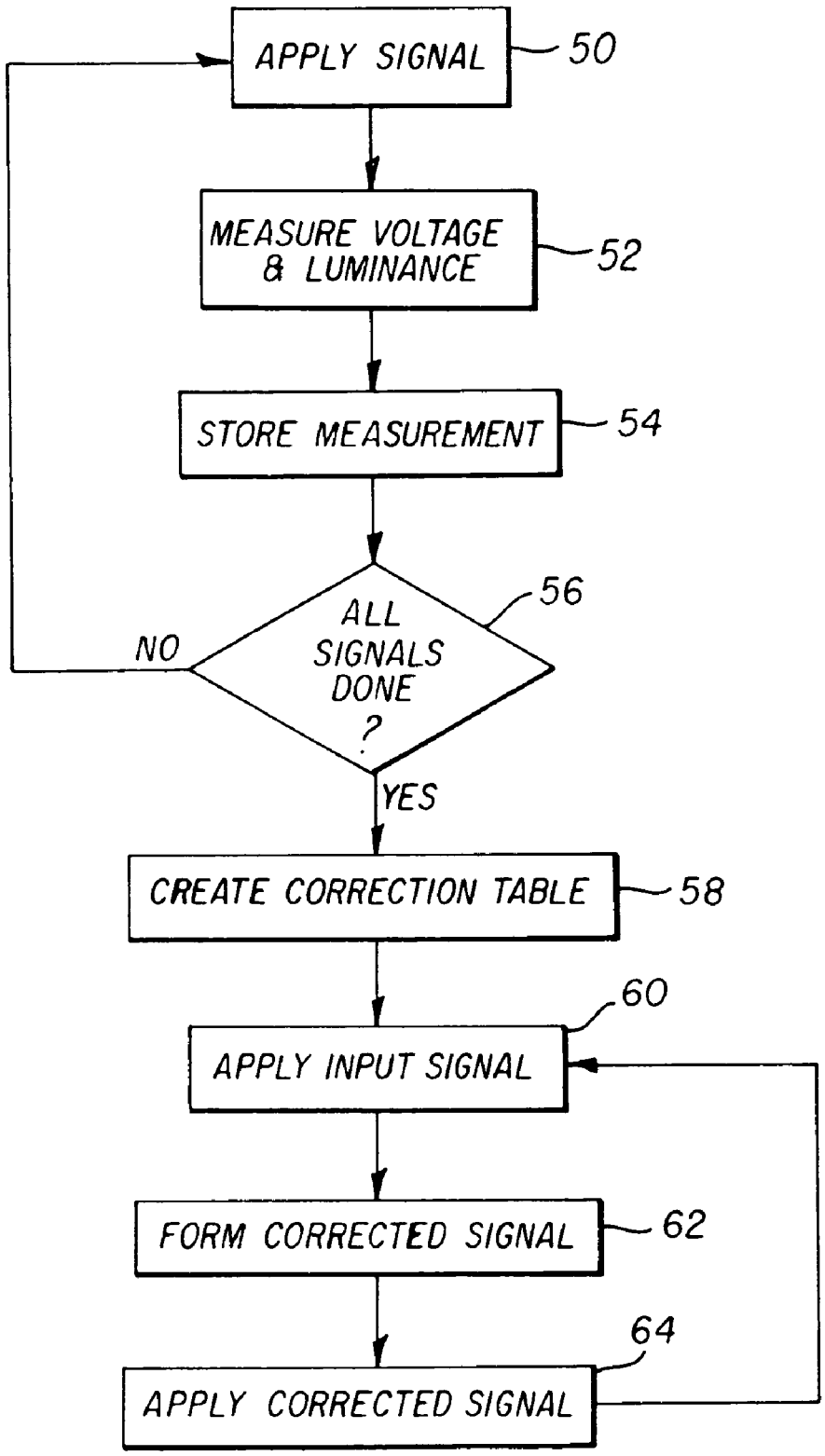
FIG. 5 is a flowchart illustrating the use of the present invention.

Referring to FIG. 5, the present invention operates as follows. Before a display is used, a given input signal is applied 50 to the one or more light emitting elements 10, a measurement 52 of the luminance from the light emitting element 10 and the corresponding feedback signal 14 is produced. The feedback signal 14 is sensed and stored 54 in the controller 16. The process is repeated 56 for each output level produced by each light emitter 10 across the range of luminance levels desired. Once the data is stored 54 in the controller 16 for each light emitter 10 and for each luminance output level desired, a conversion table is created 58 relating each input signal 26, corrected signal 24, and desired luminance level. These corrections may be applied individually to each light emitter 10 or an average correction applied to all light emitters 10. The correction may be applied using look-up tables using techniques well-known in the art. The display may then be put into use.

While in use, an input signal is applied 60 to the controller 16. The controller 16 corrects the input signal for each light emitter to form a corrected signal 62 that is applied 64 to the display and the process repeats. Periodically the display can be recalibrated to compensate for any increased aging that may have occurred. The display is temporarily removed from use and the calibration process illustrated in FIG. 5 is performed again. The display is then returned to use so that as each new input signal is applied 60, the controller forms 62 a new corrected signal and applies 64 the corrected signal to the display. The recalibration may be performed at intervals determined by the system design, for example after a specified time of use, at power-up, or power-down. Using the present invention, continuous monitoring of the display is obviated.

Over time the OLED materials will age, the resistance of the OLEDs increase, the current used for any given input signal will decrease and the feedback signal will increase. At some point in time, the controller 16 will no longer be able to provide a corrected signal that is large enough and the light emitters will have reached the end of their lifetime and can no longer meet their brightness or color specification. However, the light emitters will continue to operate as their performance declines, thus providing a graceful degradation. Moreover, the time at which the light emitters can no longer meet their specification can be signaled to a user of the display when a maximum correction is calculated, providing useful feedback on the performance of the display. The controller can allow the display luminance to degrade slowly while minimizing any differential color shift. Alternatively, the controller can reduce the pixel to pixel variability while allowing the luminance to slowly decline with use. These techniques may also be combined to allow the display to degrade slowly while minimizing differential color shift and allowing the luminance to slowly decline over time. The rate of luminance loss with age can be selected based on the anticipated usage.

OLED light emitters have associated driving circuits. The present invention can be applied to a wide variety of light emitter circuitry including voltage control (as shown in FIG. 1) or current control (not shown). Current control techniques provide a more uniform light emitter performance but are more complex to implement or to correct.

The present invention can be constructed simply, requiring only (in addition to a conventional display controller) a voltage measurement circuit, an additional line to each OLED or column of OLEDs, a transformation means for the model to perform the signal correction (for example a lookup table or amplifier), a calculation circuit to determine the correction for the given input signal. No current accumulation or time information is necessary. Although the light emitters must be periodically removed from use to perform the correction, the period between corrections may be quite large, for example days or tens of hours of use.

The present invention can be used to correct for changes in color of a color light emitter display. As noted in reference to FIG. 4, as current passes through the various light emitting elements in the pixels, the materials for each color emitter will age differently. By creating groups comprising all of the light emitting elements of a given color, and measuring the average voltage used by the display for that group, a correction for the light emitting elements of the given color can be calculated. A separate model may be applied for each color, thus maintaining a consistent color for the display. This technique will work for both displays that rely on emitters of different colors, or on a single, white emitter together with color filter arrays arranged to provide colored light emitting elements. In the latter case, the correction curves representing the loss of efficiency for each color are identical. However, the use of the colors may not be the same, so that a separate correction for each color is still necessary to maintain a constant luminance and display white point for the display.

The present invention may be extended to include complex relationships between the corrected image signal, the measured voltage, and the aging of the materials. Multiple input signals may be used corresponding to a variety of display luminance outputs. For example, a different input signal may correspond to each display output brightness level. When periodically calculating the correction signals, a separate correction signal may be obtained for each display output brightness level by using different given input signals. A separate correction signal is then employed for each display output brightness level required. As before, this can be done for each light emitter grouping, for example different light emitter color groups. Hence, the correction signals may correct for each display output brightness level for each color as each material ages.

Individual light emitters and input signals may be used to calculate the correction signals for the display providing spatially specific correction. In this way, the correction signals may apply to specific light emitters so that if a subset of light emitters age more rapidly, for example, if they are used more heavily (as an icon in a graphic user interface might), they may be corrected differently from other light emitters. Therefore, the present invention may correct for the aging of specific light emitters or groups of spatially distinct light emitters, and/or groups of colored light emitters. It is only necessary that a correction model be empirically derived for aging of each light emitter or group of light emitters and that a periodic correction signal calculation be performed by driving the light emitters to be corrected.

The correction calculation process may be performed periodically during use, at power-up or power-down. The correction calculation process may take only a few milliseconds so that the effect on any user is limited. Alternatively, the correction calculation process may be performed in response to a user signal supplied to the controller.

OLED displays dissipate significant amounts of heat and become quite hot when used over long periods of time. Further experiments by applicant have determined that there is a strong relationship between temperature and current used by the displays. Therefore, if the display has been in use for a period of time, the temperature of the display may need to be taken into account in calculating the correction signal. If it is assumed that the display has not been in use, or if the display is cooled, it may be assumed that the display is at a pre-determined ambient temperature, for example room temperature. If the correction signal model was determined at that temperature, the temperature relationship may be ignored. If the display is calibrated at power-up and the correction signal model was determined at ambient temperature, this is a reasonable presumption in most cases. For example, mobile displays with a relatively frequent and short usage profile might not need temperature correction. Display applications for which the display is continuously on for longer periods, for example, monitors, televisions, or lamps might require temperature accommodation, or can be corrected on power-up to avoid display temperature issues.

If the display is calibrated at power-down, the display may be significantly hotter than the ambient temperature and it is preferred to accommodate the calibration by including the temperature effect. This can be done by measuring the temperature of the display, for example with a thermocouple 23 (see FIG. 2) placed on the substrate or cover of the display, or a temperature sensing element, such as a thermistor, integrated into the electronics of the display. For displays that are constantly in use, the display is likely to be operated significantly above ambient temperature. The operational temperature of the display can be taken into account for the display calibration and may also be used to determine the likely rate of pixel aging. An estimate of the rate of pixel aging may be used to select an appropriate correction factor for the display device.

To further reduce the possibility of complications resulting from inaccurate current readings or inadequately compensated display temperatures, changes to the correction signals applied to the input signals may be limited by the controller. Any change in correction can be limited in magnitude, for example to a 5% change. A calculated correction signal might also be restricted to be monotonically increasing, since the aging process does not reverse. Correction changes can also be averaged over time, for example an indicated correction change can be averaged with the previous value(s) to reduce variability. Alternatively, an actual correction can be made only after taking several readings, for example, every time the display is powered on, a corrections calculation is performed and a number of calculated correction signals (e.g. 10) are averaged to produce the actual correction signal that is applied to the display.

The corrected image signal may take a variety of forms depending on the OLED display. For example, if analog voltage levels are used to specify the signal, the correction will modify the voltages of the signal. This can be done using amplifiers as is known in the art. In a second example, if digital values are used, for example corresponding to a charge deposited at an active-matrix light emitting element location, a lookup table may be used to convert the digital value to another digital value as is well known in the art. In a typical OLED display, either digital or analog video signals are used to drive the display. The actual OLED may be either voltage- or current-driven depending on the circuit used to pass current through the OLED. Again, these techniques are well known in the art.

The correction signals used to modify the input image signal to form a corrected image signal may be used to implement a wide variety of display performance attributes over time. For example, the model used to supply correction signals to an input image signal may hold the average luminance or white point of the display constant. Alternatively, the correction signals used to create the corrected image signal may allow the average luminance to degrade more slowly than it would otherwise due to aging.

In a preferred embodiment, the invention is employed in a display that includes Organic Light Emitting Diodes (OLEDs) which are composed of small molecule or polymeric OLEDs as disclosed in but not limited to U.S. Pat. No. 4,769,292, issued Sep. 6, 1988 to Tang et al., and U.S. Pat. No. 5,061,569, issued Oct. 29, 1991 to VanSlyke et al. Many combinations and variations of organic light emitting displays can be used to fabricate such a display.

General Display Architecture

The present invention can be employed in most OLED display configurations. These include very simple structures comprising a single anode and cathode to more complex displays, such as passive matrix displays comprised of orthogonal arrays of anodes and cathodes to form light emitting elements, and active-matrix displays where each light emitting element is controlled independently, for example, with thin film transistors (TFTs).

Figure 6:
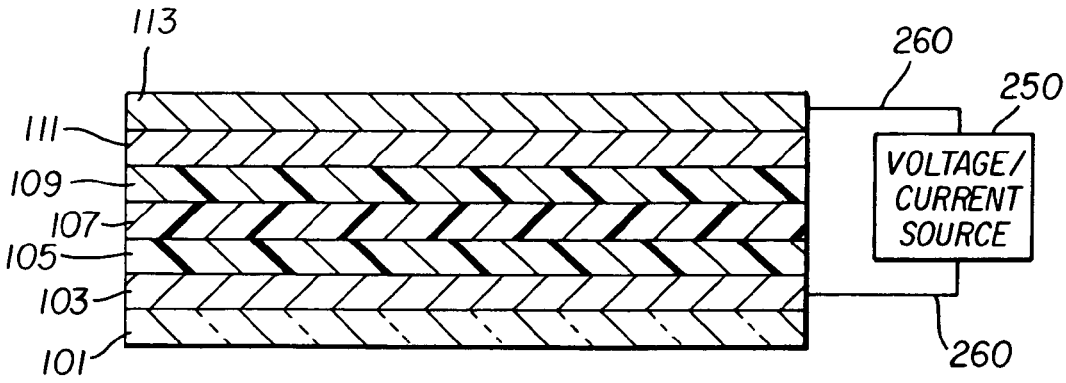
FIG. 6 (Prior Art)
FIG. 6 is a schematic diagram representing the structure of a prior art OLED useful with the present invention.

There are numerous configurations of the organic layers wherein the present invention can be successfully practiced. A typical prior art structure is shown in FIG. 6 and is comprised of a substrate 101, an anode 103, a hole-injecting layer 105, a hole-transporting layer 107, a light-emitting layer 109, an electron-transporting layer 111, and a cathode 113. These layers are described in detail below. Note that the substrate may alternatively be located adjacent to the cathode, or the substrate may actually constitute the anode or cathode. The organic layers between the anode and cathode are conveniently referred to as the organic EL element. The total combined thickness of the organic layers is preferably less than 500 nm.

The anode and cathode of the OLED are connected to a voltage/current source 250 through electrical conductors 260. The OLED is operated by applying a potential between the anode and cathode such that the anode is at a more positive potential than the cathode. Holes are injected into the organic EL element from the anode and electrons are injected into the organic EL element at the anode. Enhanced display stability can sometimes be achieved when the OLED is operated in an AC mode where, for some time period in the cycle, the potential bias is reversed and no current flows. An example of an AC-driven OLED is described in U.S. Pat. No. 5,552,678.

Substrate

The OLED display of this invention is typically provided over a supporting substrate where either the cathode or anode can be in contact with the substrate. The electrode in contact with the substrate is conveniently referred to as the bottom electrode. Conventionally, the bottom electrode is the anode, but this invention is not limited to that configuration. The substrate can either be transmissive or opaque. In the case wherein the substrate is transmissive, a reflective or light absorbing layer is used to reflect the light through the cover or to absorb the light, thereby improving the contrast of the display. Substrates can include, but are not limited to, glass, plastic, semiconductor materials, silicon, ceramics, and circuit board materials. Of course it is necessary to provide a light-transparent top electrode.

Anode

When EL emission is viewed through anode 103, the anode should be transparent or substantially transparent to the emission of interest. Common transparent anode materials used in this invention are indium-tin oxide (ITO), indium-zinc oxide (IZO) and tin oxide, but other metal oxides can work including, but not limited to, aluminum- or indium-doped zinc oxide, magnesium-indium oxide, and nickel-tungsten oxide. In addition to these oxides, metal nitrides, such as gallium nitride, and metal selenides, such as zinc selenide, and metal sulfides, such as zinc sulfide, can be used as the anode. For applications where EL emission is viewed only through the cathode electrode, the transmissive characteristics of anode are immaterial and any conductive material can be used, transparent, opaque or reflective. Example conductors for this application include, but are not limited to, gold, iridium, molybdenum, palladium, and platinum. Typical anode materials, transmissive or otherwise, have a work function of 4.1 eV or greater. Desired anode materials are commonly deposited by any suitable means such as evaporation, sputtering, chemical vapor deposition, or electrochemical means. Anodes can be patterned using well-known photolithographic processes. Optionally, anodes may be polished prior to application of other layers to reduce surface roughness so as to minimize shorts or enhance reflectivity.

Hole-Injecting Layer (HIL)

While not always necessary, it is often useful to provide a hole-injecting layer 105 between anode 103 and hole-transporting layer 107. The hole-injecting material can serve to improve the film formation property of subsequent organic layers and to facilitate injection of holes into the hole-transporting layer. Suitable materials for use in the hole-injecting layer include, but are not limited to, porphyrinic compounds as described in U.S. Pat. No. 4,720,432, plasma-deposited fluorocarbon polymers as described in U.S. Pat. No. 6,208,075, and some aromatic amines, for example, m-MTDATA (4,4',4"-tris[(3-methylphenyl)phenylamino]triphenylamine). Alternative hole-injecting materials reportedly useful in organic EL displays are described in EP 0 891 121 A1 and EP 1 029 909 A1.

Hole-Transporting Layer (HTL)

The hole-transporting layer 107 contains at least one hole-transporting compound such as an aromatic tertiary amine, where the latter is understood to be a compound containing at least one trivalent nitrogen atom that is bonded only to carbon atoms, at least one of which is a member of an aromatic ring. In one form the aromatic tertiary amine can be an arylamine, such as a monoarylamine, diarylamine, triarylamine, or a polymeric arylamine. Exemplary monomeric triarylamines are illustrated by Klupfel et al. U.S. Pat. No. 3,180,730. Other suitable triarylamines substituted with one or more vinyl radicals and/or comprising at least one active hydrogen containing group are disclosed by Brantley et al U.S. Pat. Nos. 3,567,450 and 3,658,520.

A more preferred class of aromatic tertiary amines are those which include at least two aromatic tertiary amine moieties as described in U.S. Pat. Nos. 4,720,432 and 5,061,569. The hole-transporting layer can be formed of a single or a mixture of aromatic tertiary amine compounds. Illustrative of useful aromatic tertiary amines are the following:

1,1-Bis(4-di-p-tolylaminophenyl)cyclohexane
1,1-Bis(4-di-p-tolylaminophenyl)-4-phenylcyclohexane
4,4'-Bis(diphenylamino)quadriphenyl
Bis(4-dimethylamino-2-methylphenyl)-phenylmethane
N,N,N-Tri(p-tolyl)amine
4-(di-p-tolylamino)-4'-[4(di-p-tolylamino)-styryl]stilbene
N,N,N',N'-Tetra-p-tolyl-4-4'-diaminobiphenyl
N,N,N',N'-Tetraphenyl-4,4'-diaminobiphenyl
N,N,N',N'-tetra-1-naphthyl-4,4'-diaminobiphenyl
N,N,N',N'-tetra-2-naphthyl-4,4'-diaminobiphenyl
N-Phenylcarbazole
4,4'-Bis[N-(1-naphthyl)-N-phenylamino]biphenyl
4,4'-Bis[N-(1-naphthyl)-N-(2-naphthyl)amino]biphenyl
4,4"-Bis[N-(1-naphthyl)-N-phenylamino]p-terphenyl
4,4'-Bis[N-(2-naphthyl)-N-phenylamino]biphenyl
4,4'-Bis[N-(3-acenaphthenyl)-N-phenylamino]biphenyl
1,5-Bis[N-(1-naphthyl)-N-phenylamino]naphthalene
4,4'-Bis[N-(9-anthryl)-N-phenylamino]biphenyl
4,4"-Bis[N-(1-anthryl)-N-phenylamino]-p-terphenyl
4,4'-Bis[N-(2-phenanthryl)-N-phenylamino]biphenyl
4,4'-Bis[N-(8-fluoranthenyl)-N-phenylamino]biphenyl
4,4'-Bis[N-(2-pyrenyl)-N-phenylamino]biphenyl
4,4'-Bis[N-(2-naphthacenyl)-N-phenylamino]biphenyl
4,4'-Bis[N-(2-perylenyl)-N-phenylamino]biphenyl 4,4'-Bis[N-(1-coronenyl)-N-phenylamino]biphenyl
2,6-Bis(di-p-tolylamino)naphthalene
2,6-Bis[di-(1-naphthyl)amino]naphthalene
2,6-Bis[N-(1-naphthyl)-N-(2-naphthyl)amino]naphthalene
N,N,N',N'-Tetra(2-naphthyl)-4,4"-diamino-p-terphenyl
4,4'-Bis {N-phenyl-N-[4-(1-naphthyl)-phenyl] amino}biphenyl
4,4'-Bis[N-phenyl-N-(2-pyrenyl)amino]biphenyl
2,6-Bis[N,N-di(2-naphthyl)amine]fluorene
1,5-Bis[N-(1-naphthyl)-N-phenylamino]naphthalene
4,4',4"-tris[(3-methylphenyl)phenylamino]triphenylamine Another class of useful hole-transporting materials includes polycyclic aromatic compounds as described in EP 1 009 041. Tertiary aromatic amines with more than two amine groups may be used including oligomeric materials. In addition, polymeric hole-transporting materials can be used such as poly(N-vinylcarbazole) (PVK), polythiophenes, polypyrrole, polyaniline, and copolymers such as poly(3,4-ethylenedioxythiophene)/poly(4-styrenesulfonate) also called PEDOT/PSS.

Light-Emitting Layer (LEL)

As more fully described in U.S. Pat. Nos. 4,769,292 and 5,935,721, the light-emitting layer (LEL) 109 of the organic EL element includes a luminescent or fluorescent material where electroluminescence is produced as a result of electron-hole pair recombination in this region. The light-emitting layer can be comprised of a single material, but more commonly consists of a host material doped with a guest compound or compounds where light emission comes primarily from the dopant and can be of any color. The host materials in the light-emitting layer can be an electron-transporting material, as defined below, a hole-transporting material, as defined above, or another material or combination of materials that support hole-electron recombination. The dopant is usually chosen from highly fluorescent dyes, but phosphorescent compounds, e.g., transition metal complexes as described in WO 98/55561, WO 00/18851, WO 00/57676, and WO 00/70655 are also useful. Dopants are typically coated as 0.01 to 10% by weight into the host material. Polymeric materials such as polyfluorenes and polyvinylarylenes (e.g., poly(p-phenylenevinylene), PPV) can also be used as the host material. In this case, small molecule dopants can be molecularly dispersed into the polymeric host, or the dopant could be added by copolymerizing a minor constituent into the host polymer.

An important relationship for choosing a dye as a dopant is a comparison of the bandgap potential which is defined as the energy difference between the highest occupied molecular orbital and the lowest unoccupied molecular orbital of the molecule. For efficient energy transfer from the host to the dopant molecule, a necessary condition is that the band gap of the dopant is smaller than that of the host material. For phosphorescent emitters it is also important that the host triplet energy level of the host be high enough to enable energy transfer from host to dopant.

Host and emitting molecules known to be of use include, but are not limited to, those disclosed in U.S. Pat. Nos. 4,768,292; 5,141,671; 5,150,006; 5,151,629; 5,405,709; 5,484,922; 5,593,788; 5,645,948; 5,683,823; 5,755,999; 5,928,802; 5,935,720; 5,935,721; and 6,020,078.

Metal complexes of 8-hydroxyquinoline (oxine) and similar derivatives constitute one class of useful host compounds capable of supporting electroluminescence. Illustrative of useful chelated oxinoid compounds are the following:

CO-1: Aluminum trisoxine [alias, tris(8-quinolinolato)aluminum(III)]
CO-2: Magnesium bisoxine [alias, bis(8-quinolinolato)magnesium(II)]
CO-3: Bis[benzo {f}-8-quinolinolato]zinc (II)
CO-4: Bis(2-methyl-8-quinolinolato)aluminum(III)-□-oxo-bis(2-methyl-8-quinolinolato) aluminum(III)
CO-5: Indium trisoxine [alias, tris(8-quinolinolato)indium]
CO-6: Aluminum tris(5-methyloxine)[alias, tris(5-methyl-8-quinolinolato) aluminum(III)]
CO-7: Lithium oxine [alias, (8-quinolinolato)lithium(I)]
CO-8: Gallium oxine [alias, tris(8-quinolinolato)gallium (III)]
CO-9: Zirconium oxine [alias, tetra(8-quinolinolato)zirconium(IV)]

Other classes of useful host materials include, but are not limited to: derivatives of anthracene, such as 9,10-di-(2-naphthyl)anthracene and derivatives thereof as described in U.S. Pat. No. 5,935,721, distyrylarylene derivatives as described in U.S. Pat. No. 5,121,029, and benzazole derivatives, for example, 2, 2', 2"-(1,3,5-phenylene)tris[1-phenyl-1H-benzimidazole]. Carbazole derivatives are particularly useful hosts for phosphorescent emitters.

Useful fluorescent dopants include, but are not limited to, derivatives of anthracene, tetracene, xanthene, perylene, rubrene, coumarin, rhodamine, and quinacridone, dicyanomethylenepyran compounds, thiopyran compounds, polymethine compounds, pyrilium and thiapyrilium compounds, fluorene derivatives, periflanthene derivatives, indenoperylene derivatives, bis(azinyl)amine boron compounds, bis(azinyl)methane compounds, and carbostyryl compounds.

Electron-Transporting Layer (ETL)

Preferred thin film-forming materials for use in forming the electron-transporting layer 111 of the organic EL elements of this invention are metal chelated oxinoid compounds, including chelates of oxine itself (also commonly referred to as 8-quinolinol or 8-hydroxyquinoline). Such compounds help to inject and transport electrons, exhibit high levels of performance, and are readily fabricated in the form of thin films. Exemplary oxinoid compounds were listed previously.

Other electron-transporting materials include various butadiene derivatives as disclosed in U.S. Pat. No. 4,356,429 and various heterocyclic optical brighteners as described in U.S. Pat. No. 4,539,507. Benzazoles and triazines are also useful electron-transporting materials.

Cathode

When light emission is viewed solely through the anode, the cathode 113 used in this invention can be comprised of nearly any conductive material. Desirable materials have good film-forming properties to ensure good contact with the underlying organic layer, promote electron injection at low voltage, and have good stability. Useful cathode materials often contain a low work function metal (<4.0 eV) or metal alloy. One preferred cathode material is comprised of a Mg:Ag alloy wherein the percentage of silver is in the range of 1 to 20%, as described in U.S. Pat. No. 4,885,221. Another suitable class of cathode materials includes bilayers comprising a thin electron-injection layer (EIL) in contact with the organic layer (e.g., ETL) which is capped with a thicker layer of a conductive metal. Here, the EIL preferably includes a low work function metal or metal salt, and if so, the thicker capping layer does not need to have a low work function. One such cathode is comprised of a thin layer of LiF followed by a thicker layer of A1 as described in U.S. Pat. No. 5,677,572. Other useful cathode material sets include, but are not limited to, those disclosed in U.S. Pat. Nos. 5,059,861, 5,059,862, and 6,140,763.

When light emission is viewed through the cathode, the cathode must be transparent or nearly transparent. For such applications, metals must be thin or one must use transparent conductive oxides, or a combination of these materials. Optically transparent cathodes have been described in more detail in U.S. Pat. No. 4,885,211, U.S. Pat. No. 5,247,190, JP 3,234,963, U.S. Pat. No. 5,703,436, U.S. Pat. No. 5,608,287, U.S. Pat. No. 5,837,391, U.S. Pat. No. 5,677,572, U.S. Pat. No. 5,776,622, U.S. Pat. No. 5,776,623, U.S. Pat. No. 5,714,838, U.S. Pat. No. 5,969,474, U.S. Pat. No. 5,739,545, U.S. Pat. No. 5,981,306, U.S. Pat. No. 6,137,223, U.S. Pat. No. 6,140,763, U.S. Pat. No. 6,172,459, EP 1 076 368, U.S. Pat. No. 6,278,236, and U.S. Pat. No. 6,284,393. Cathode materials are typically deposited by evaporation, sputtering, or chemical vapor deposition. When needed, patterning can be achieved through many well known methods including, but not limited to, through-mask deposition, integral shadow masking, for example, as described in U.S. Pat. No. 5,276,380 and EP 0 732 868, laser ablation, and selective chemical vapor deposition.

Other Common Organic Layers and Display Architecture

In some instances, layers 109 and 111 can optionally be collapsed into a single layer that serves the function of supporting both light emission and electron transportation. It also known in the art that emitting dopants may be added to the hole-transporting layer, which may serve as a host. Multiple dopants may be added to one or more layers in order to create a white-emitting OLED, for example, by combining blue- and yellow-emitting materials, cyan- and red-emitting materials, or red-, green-, and blue-emitting materials. White-emitting displays are described, for example, in EP 1 187 235, U.S. 20020025419, EP 1 182 244, U.S. Pat. No. 5,683,823, U.S. Pat. No. 5,503,910, U.S. Pat. No. 5,405,709, and U.S. Pat. No. 5,283,182.

Additional layers such as electron or hole-blocking layers as taught in the art may be employed in displays of this invention. Hole-blocking layers are commonly used to improve efficiency of phosphorescent emitter displays, for example, as in U.S. 20020015859.

This invention may be used in so-called stacked display architecture, for example, as taught in U.S. Pat. No. 5,703,436 and U.S. Pat. No. 6,337,492.

Deposition of Organic Layers

The organic materials mentioned above are suitably deposited through a vapor-phase method such as sublimation, but can be deposited from a fluid, for example, from a solvent with an optional binder to improve film formation. If the material is a polymer, solvent deposition is useful but other methods can be used, such as sputtering or thermal transfer from a donor sheet. The material to be deposited by sublimation can be vaporized from a sublimator "boat" often comprised of a tantalum material, e.g., as described in U.S. Pat. No. 6,237,529, or can be first coated onto a donor sheet and then sublimed in closer proximity to the substrate. Layers with a mixture of materials can utilize separate sublimator boats or the materials can be pre-mixed and coated from a single boat or donor sheet. Patterned deposition can be achieved using shadow masks, integral shadow masks (U.S. Pat. No. 5,294,870), spatially-defined thermal dye transfer from a donor sheet (U.S. Pat. Nos. 5,688,551, 5,851,709 and 6,066,357) and inkjet method (U.S. Pat. No. 6,066,357).

Encapsulation

Most OLED displays are sensitive to moisture or oxygen, or both, so they are commonly sealed in an inert atmosphere such as nitrogen or argon, along with a desiccant such as alumina, bauxite, calcium sulfate, clays, silica gel, zeolites, alkaline metal oxides, alkaline earth metal oxides, sulfates, or metal halides and perchlorates. Methods for encapsulation and desiccation include, but are not limited to, those described in U.S. Pat. No. 6,226,890. In addition, barrier layers such as SiOx, Teflon, and alternating inorganic/polymeric layers are known in the art for encapsulation.

Optical Optimization

OLED displays of this invention can employ various well-known optical effects in order to enhance its properties if desired. This includes optimizing layer thicknesses to yield maximum light transmission, providing dielectric mirror structures, replacing reflective electrodes with light-absorbing electrodes, providing anti glare or anti-reflection coatings over the display, providing a polarizing medium over the display, or providing colored, neutral density, or color conversion filters over the display. Filters, polarizers, and anti-glare or anti-reflection coatings may be specifically provided over the cover or an electrode protection layer beneath the cover.

The invention has been described in detail with particular reference to certain preferred embodiments thereof, but it will be understood that variations and modifications can be effected within the spirit and scope of the invention.

PARTS LIST

10 OLED light emitting element
12 transistor
14 feedback signal
15 load resistor
16 controller
20 substrate
22 array
23 thermocouple
24 corrected control signals
26 input signals
30 select signal
32 select transistor
40 pixels
42 shift register
50 apply input signal step
52 measurement step
54 store step
56 repeat step
58 create table step
60 apply input signal step
62 form corrected signal step
64 apply corrected signal step
101 substrate
103 anode
105 hole injecting layer
107 hole transporting layer
109 light emitting layer
111 electron-transporting layer
113 cathode
250 voltage/current source
260 electrical conductors

What is claimed is:

1. An organic light emitting diode (OLED) display, comprising:

a) an array of OLED display light-emitting elements, each OLED display light-emitting element having two terminals;

b) a voltage sensing circuit for each OLED display light-emitting element in the display array including a transistor in each circuit connected to one of the terminals of a corresponding OLED display light-emitting element for sensing the voltage across the OLED display light-emitting element to produce feedback signals representing the voltage across the OLED display light-emitting elements in the display array; and c) a controller responsive to the feedback signals for calculating a correction signal for each OLED display light-emitting element and applying the correction signal to data used to drive each OLED display light-emitting element to compensate for the changes in the output of each OLED display light-emitting element.

2. The OLED display claimed in claim 1, wherein the output of the OLEDs change with temperature, and further comprising a temperature sensor for generating a temperature signal and wherein the controller is also responsive to the temperature signal to calculate the correction signal.

3. The OLED display claimed in claim 1, wherein the controller further includes a lookup table having a correction signal for each of the OLEDs.

4. The OLED display claimed in claim 1, wherein the controller sequentially activates individual OLED to measure the voltage associated with each OLED element.

5. The OLED display claimed in claim 1, wherein the controller activates one or more OLED elements at a plurality of different brightness levels to calculate the correction signal.

* * * * *